US006419744B1

(12) United States Patent
Southworth

(10) Patent No.: US 6,419,744 B1
(45) Date of Patent: Jul. 16, 2002

(54) SHEET COATING MACHINE

(75) Inventor: Christopher John Morrison Southworth, Gateshead (GB)

(73) Assignee: Crabtree of Gateshead Ltd. (GB)

( * ) Notice: Subject to any disclaimer, the term of this patent is extended or adjusted under 35 U.S.C. 154(b) by 0 days.

(21) Appl. No.: 09/445,893

(22) PCT Filed: Jun. 16, 1998

(86) PCT No.: PCT/GB98/01608

§ 371 (c)(1),
(2), (4) Date: Mar. 3, 2000

(87) PCT Pub. No.: WO98/57758

PCT Pub. Date: Dec. 23, 1998

(30) Foreign Application Priority Data

Jun. 18, 1997 (GB) ..... 9712709

(51) Int. Cl.[7] ..... B05C 11/00
(52) U.S. Cl. ..... 118/68; 118/58
(58) Field of Search ..... 118/58, 61, 326, 118/309, 236, 46, 68, 712, 713, 66; 454/195; 49/144, 146, 171, 391, 471

(56) References Cited

U.S. PATENT DOCUMENTS 4,600,608 A * 7/1986 Ankrett ..... 427/424
4,714,010 A * 12/1987 Smart ..... 98/115.4
4,865,872 A * 9/1989 Pellatiro ..... 427/9
4,874,412 A * 10/1989 Nowack ..... 55/385.1
5,023,116 A * 6/1991 Williams et al. ..... 427/424
5,246,501 A * 9/1993 Rodgers et al. ..... 134/10

FOREIGN PATENT DOCUMENTS

GB 2015384 A 9/1979
GB 2060161 A 4/1981

OTHER PUBLICATIONS

PCT International Search Report relating to PCT/GB 98/01608.
Search Report under Section 17 relating to GB 9813080.0.

* cited by examiner

*Primary Examiner*—Richard Crispino
*Assistant Examiner*—Yewebdar T Tadesse
(74) *Attorney, Agent, or Firm*—Trexler, Bushnell, Giangiorgi, Blackstone & Marr, Ltd.

(57) ABSTRACT

A sheet coating machine in which sheets are fed along a bed through a working area where they are given a coating of a volatile substance to an adjoining oven where the coating is cured. At least one cover is moveable to provide access when necessary to the working area and which enables vapors produced by evaporation from the substance to be contained within the working area. Air inlet means enable the vapors to be extracted for incineration, and suction means which are arranged to extract the vapors downwardly from within the working area.

11 Claims, 9 Drawing Sheets

SHEET COATING MACHINE

This invention relates to sheet coating machines, that is to say to machines for coating sheets with a variety of substances most of which include high quantities of volatile organic solvents which are evaporated off and incinerated during a following curing process in a thermal drying oven. However, very significant amounts of solvent vapourise at the machine, and health and safety regulations require that these are not dissipated into the atmosphere but are incinerated.

It is well known to enclose the coating machine entirely within a front extension of the oven, thus containing the solvent emissions from the machine within the oven. However, this arrangement has the disadvantages that the atmosphere within the extension must be acceptable to an operator working therein for the purposes of setting and checking the machine, but the size of the extension requires that a high rate of air flow into it is needed to keep the atmosphere acceptable, which in turn lowers the thermal efficiency of the oven; and that machine elements and coating substances have to be transported into and handled within the confines of the extension.

It is also known to enclose the coating machine entirely within a sizeable chamber separate from the oven, to provide a tunnel connecting the chamber and the oven through which the sheets are transported, and to provide an extraction system for the chamber. This arrangement suffers from the same disadvantages as the arrangement referred to in the preceding paragraph.

There has also been produced hitherto a coating machine with a hood above it enabling vapours to be contained within the working area and having two covers which could be raised to provide access to said area. An extraction system was mounted above the machine on or adjacent to the hood between the covers, drawing the vapours upwardly. This arrangement has the disadvantages that the hood and the extraction system hinder the installation and use of a hoist for enabling machine elements to be changed; that extraction is less effective because the vapours are heavier than air; and that during setting and checking of the machine when one or both of the covers is or are raised and the extraction system is still in operation, vapours are drawn upwardly past the head of the operator.

The object of the present invention is to avoid all of the disadvantages hereinbefore referred to.

The invention comprises a sheet coating machine in which sheets are fed along a bed through a working area where they are given a coating of a volatile substance to an adjoining oven where the coating is cured, at least one cover which is moveable to provide access when necessary to the working area and which enables vapours produced by evaporation from the substance to be contained within the working area, air inlet means which enable the vapours to be extracted for incineration, and suction means which are arranged to extract the vapours downwardly from within the working area.

The working area preferably comprises a coating station having a moveable cover which provides access when necessary to the coating station.

Preferably, the air inlet means of the coating station comprise vents in the moveable cover.

Preferably, also, the coating station is provided with a base, walls along its sides, and upstream and downstream baffle plates across its ends in order to contain the vapours within the coating station, the baffle plates being adapted to permit feeding of the sheets along the bed.

Preferably, the working area comprises also a sheet reject station disposed between the coating station and the oven and having another moveable cover which provides access when necessary to the sheet reject station.

Preferably, also, the sheet reject station is provided with a floor, walls along its sides, and upstream and downstream baffle plates across its ends in order to contain the vapours within the sheet reject station, the baffle plates being adapted to permit feeding of the sheets along the bed.

Preferably, the walls of the sheet resect station are continuations of the walls of the coating station, and the upstream baffle plate of the sheet reject station and the downstream baffle plate of the coating station are one and the same element.

Preferably, also, the air inlet means of the sheet reject station comprise vents in a reject sheet withdrawal door in one of the walls.

Preferably, the suction means which are arranged to extract the vapours downwardly comprise ducts connected to the base of the coating station, to the sheet reject station, to a gearbox for driving the machine, and to a housing for a replaceable tank from which the substance is supplied to the coating station.

Preferably, also, the ducts communicate with a common duct in the base of the machine leading to an upper zone of the oven.

The sheet coating machine is preferably provided with a hoist for enabling machine elements to be changed which is disposed above the working area and is completely unimpeded by the suction means which are arranged to extract the vapours downwardly.

A preferred embodiment of the invention will now be described, by way of example, with reference to the accompanying drawings on different scales of which:

FIG. 1 shown in two parts 1A and 1B is a side elevation of a sheet coating machine with an adjoining sheet supplying mechanism shown in broken lines at its right hand end and an adjoining oven shown in broken lines at its left hand end;

FIG. 2 shown in two parts 2A and 2B is a plan view the machine with said mechanism shown in broken lines but with the oven omitted;

Figure 1:
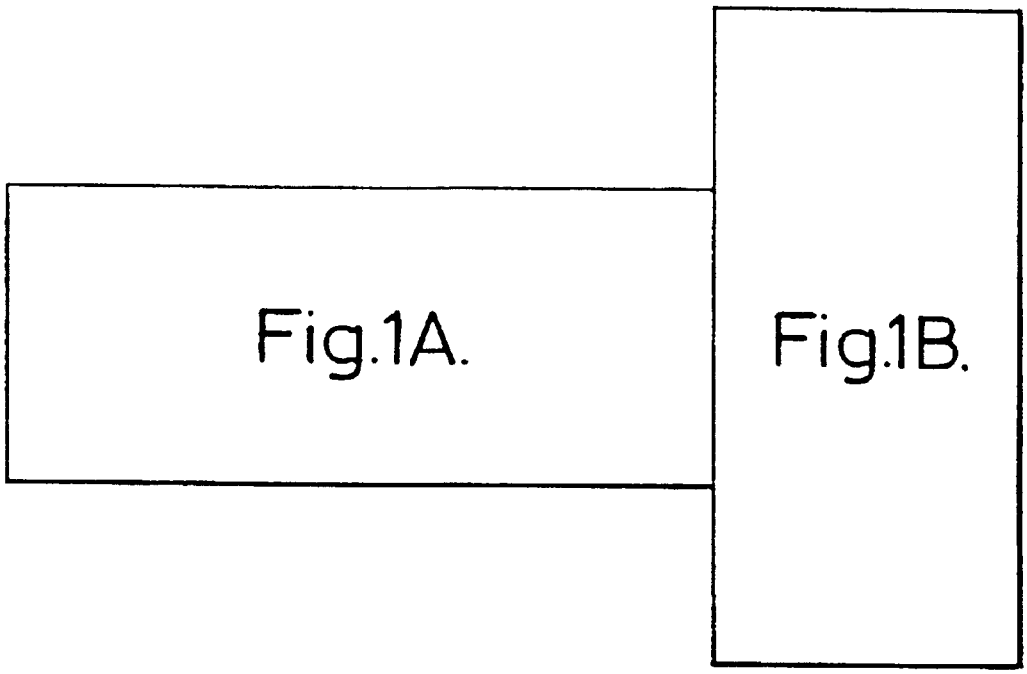
Figure 2:
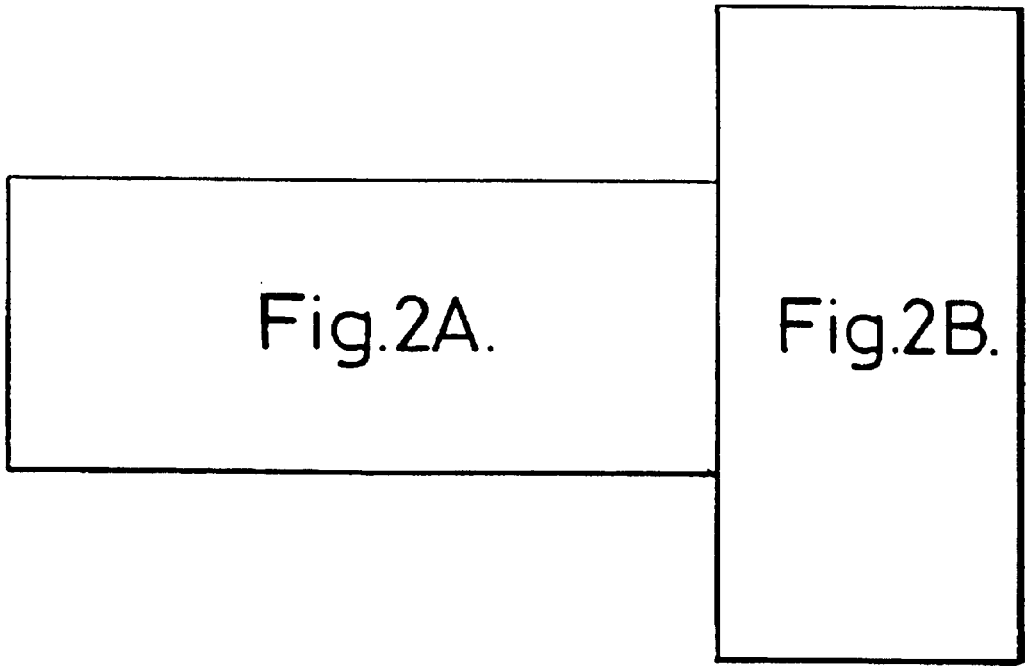
Figure 1A:
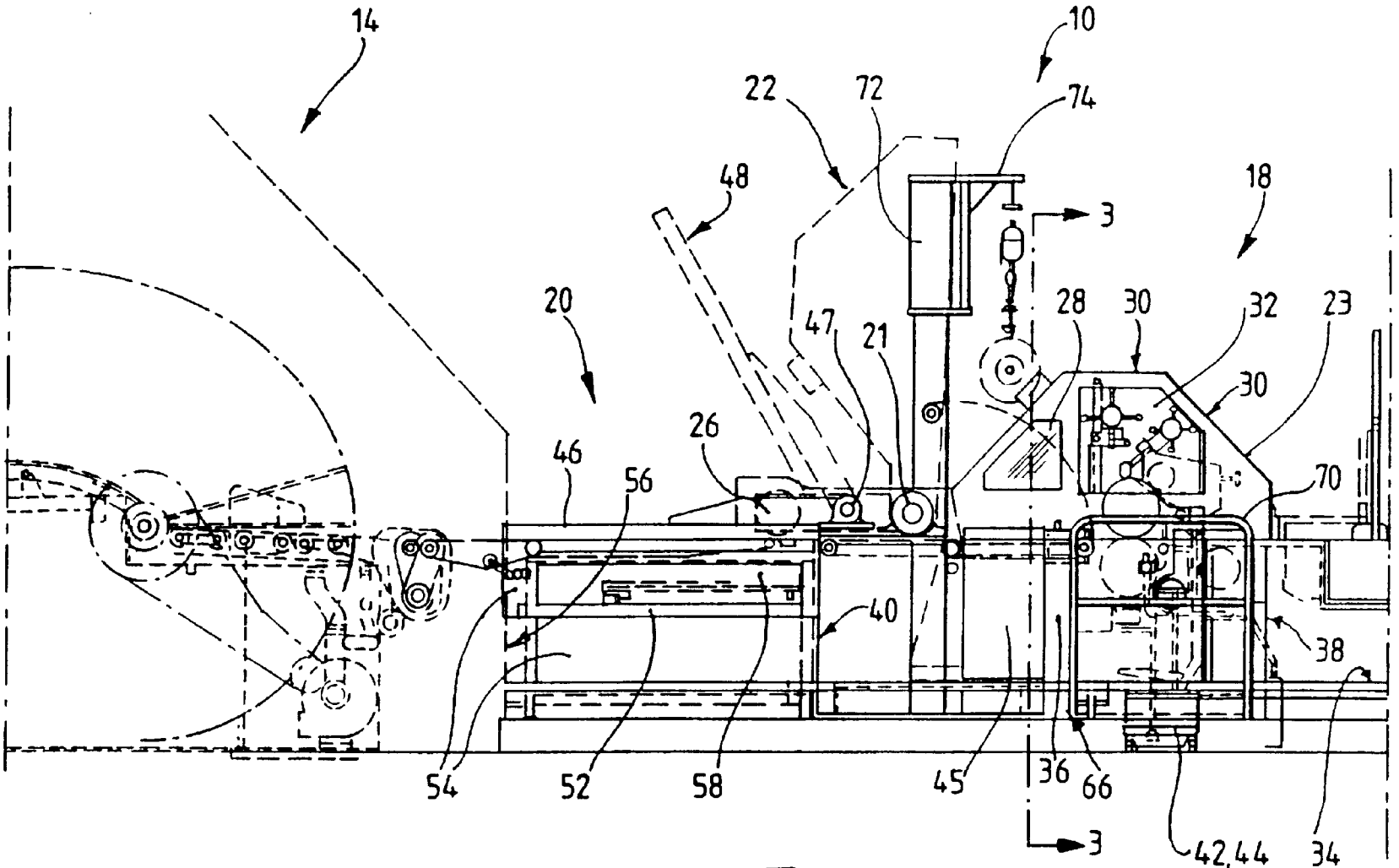
Figure 1B:
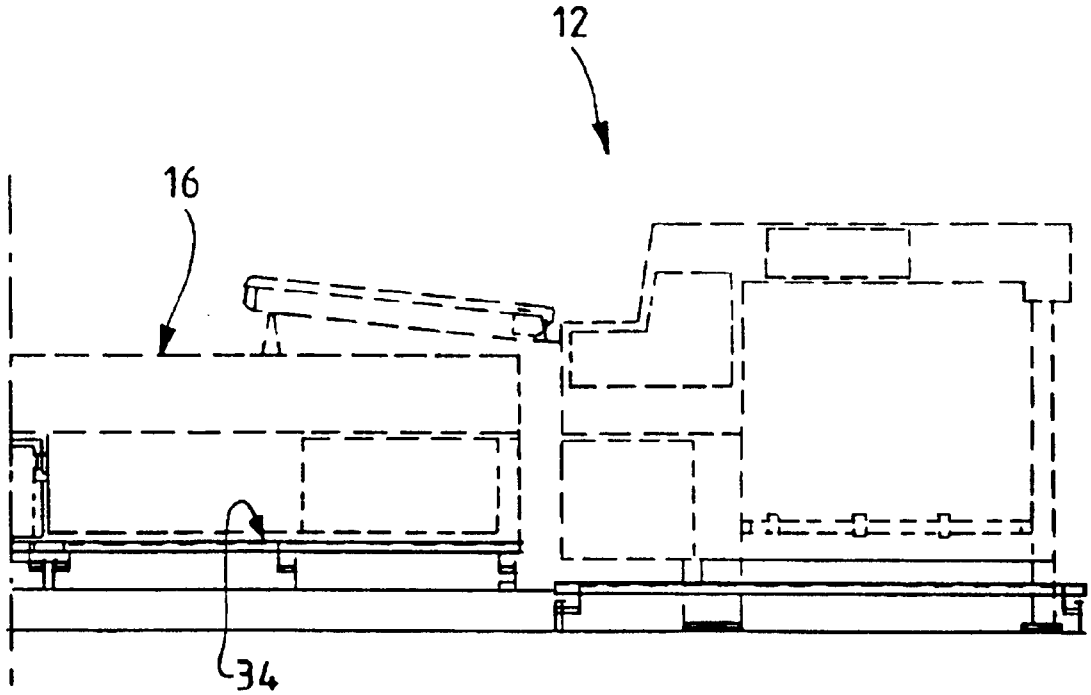
Figure 2A:
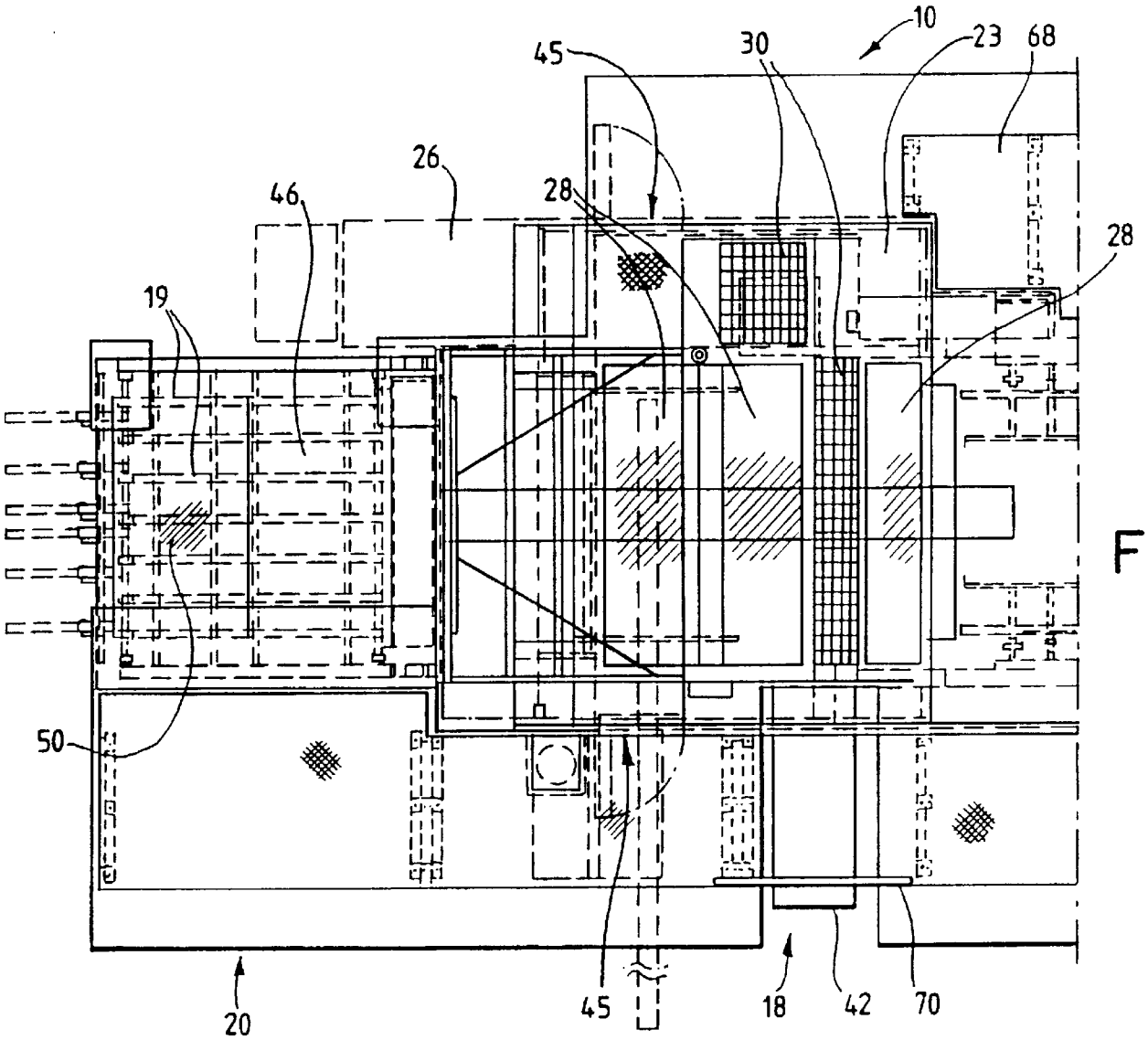
Figure 2B:
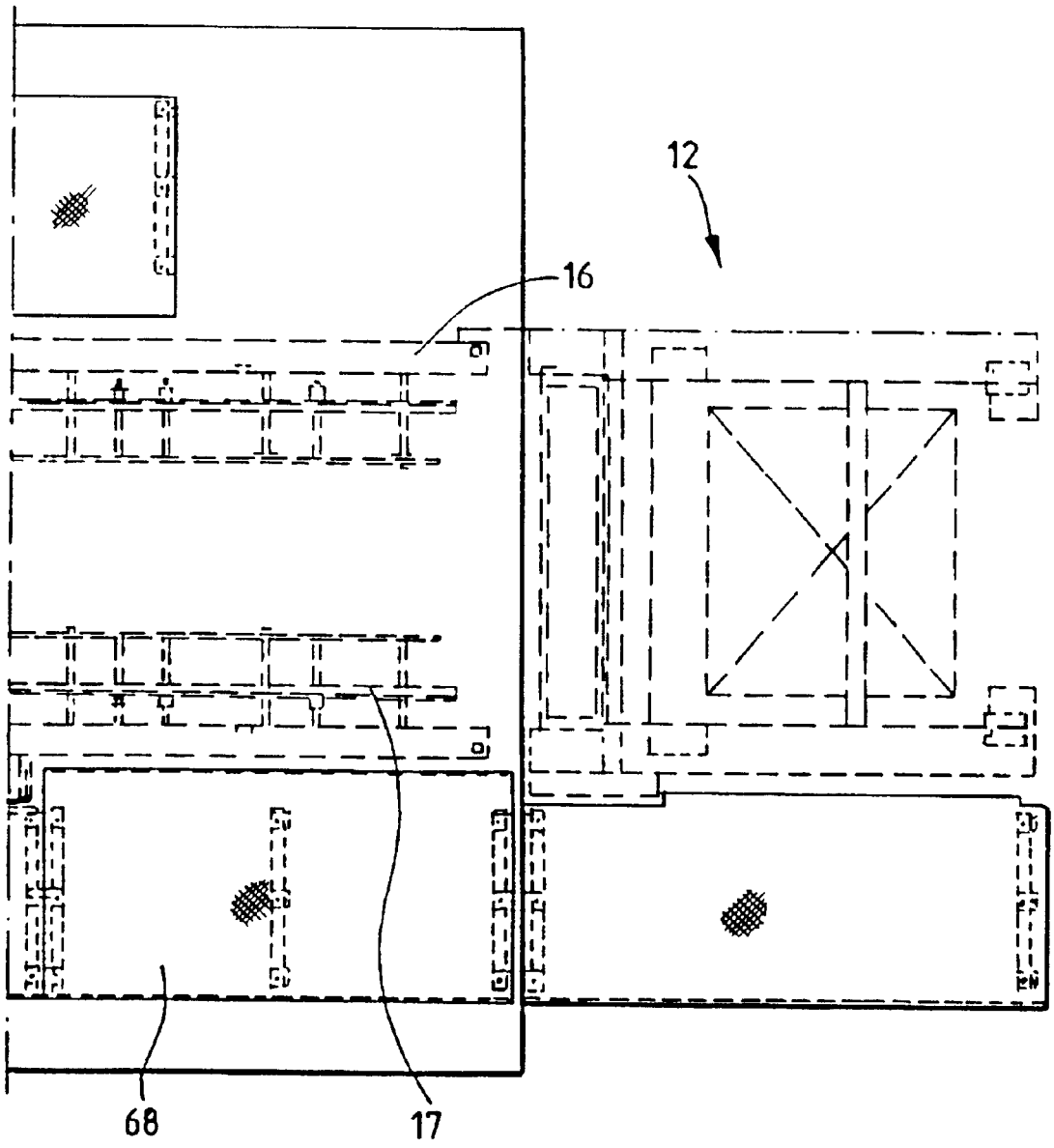
Figure 3:
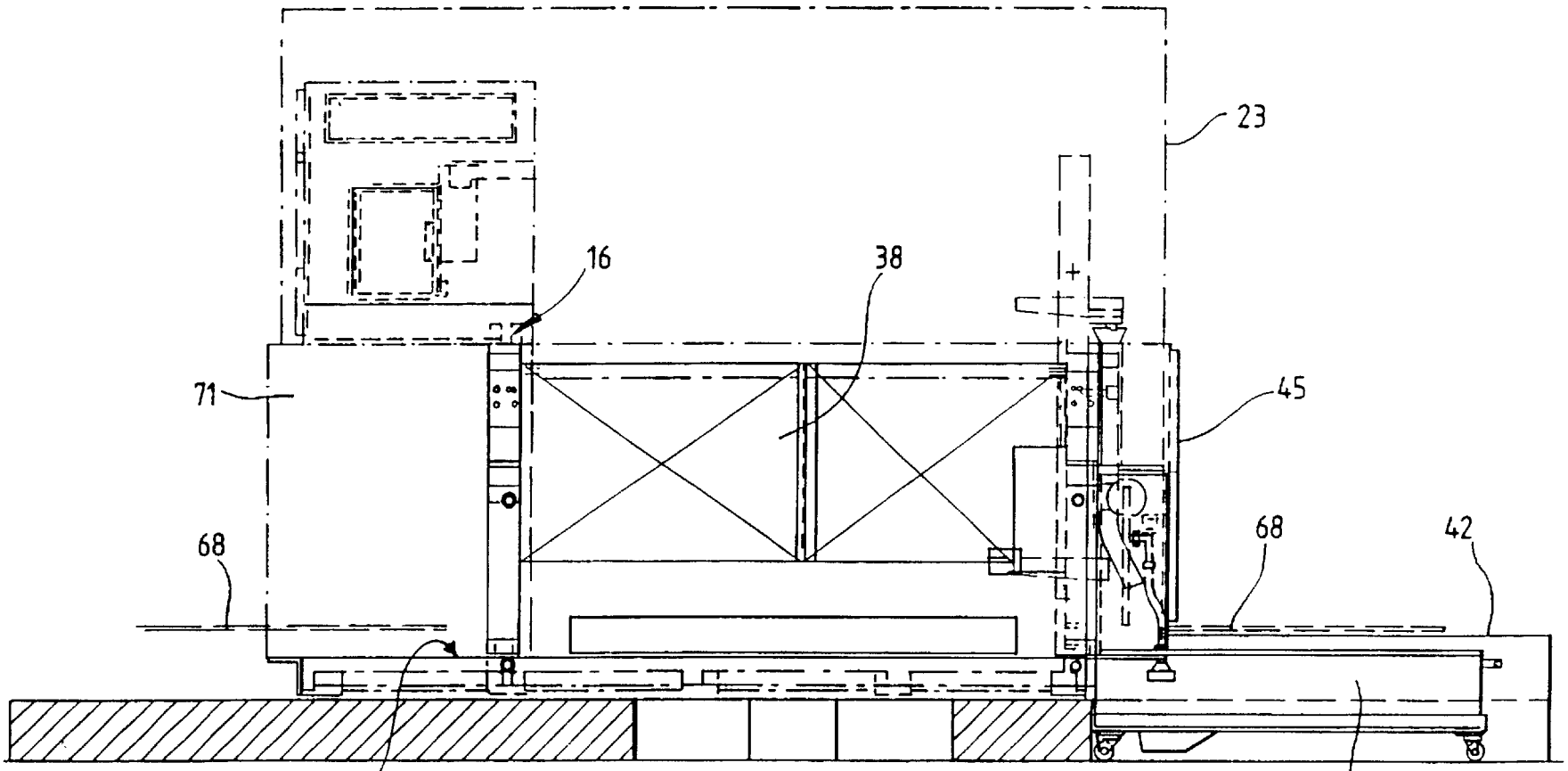
FIG. 3 is a cross-section on the line 3—3 in FIG. 1 with parts omitted for clarity.
Figure 4:
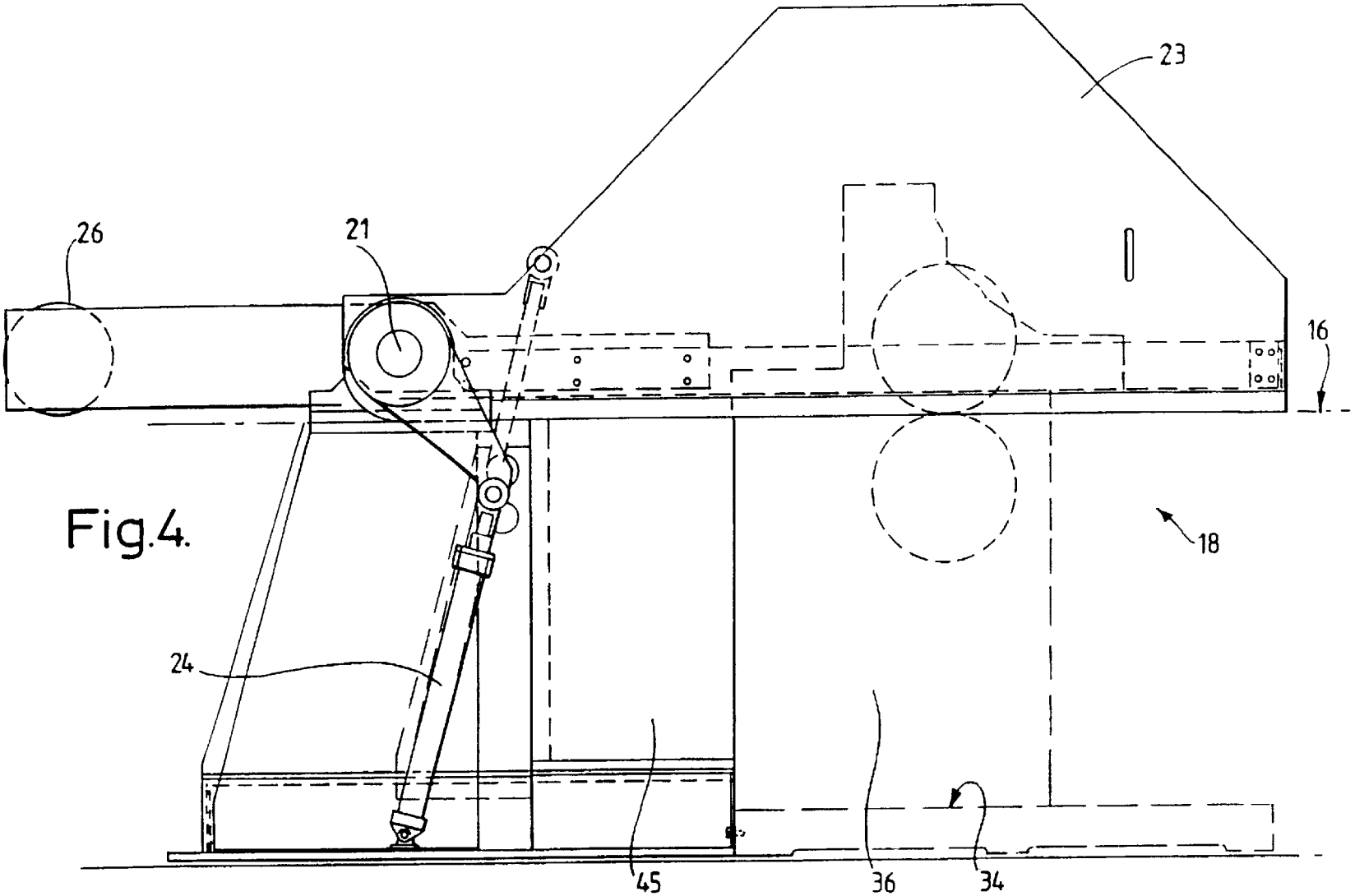
FIG. 4 is a side elevation of means for pivotally raising the cover of the coating station.
Figure 5:
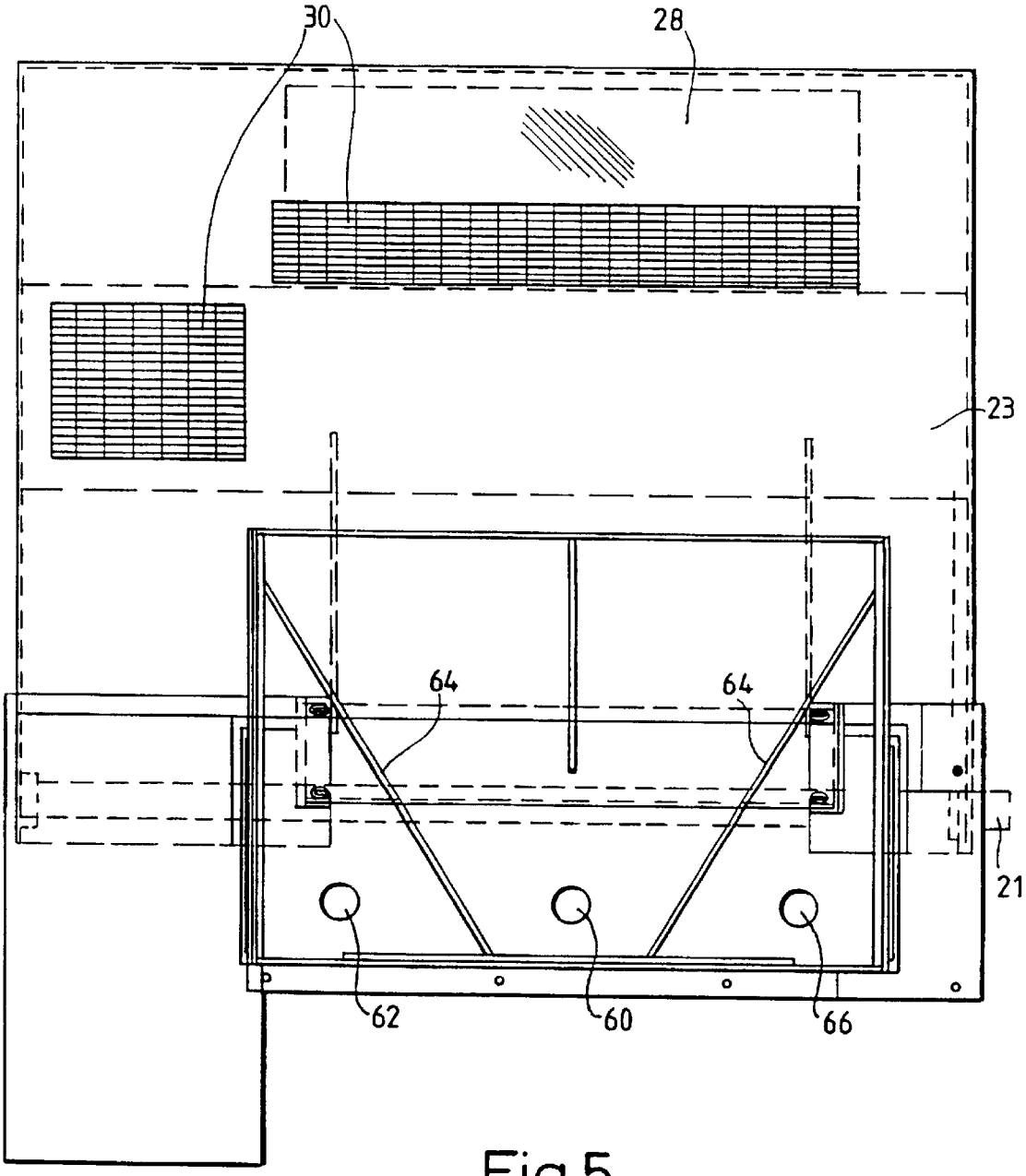
FIG. 5 is a plan view of said cover included to show some of the machine's extraction ducts disposed beneath it in the base of the coating station.
Figure 6:
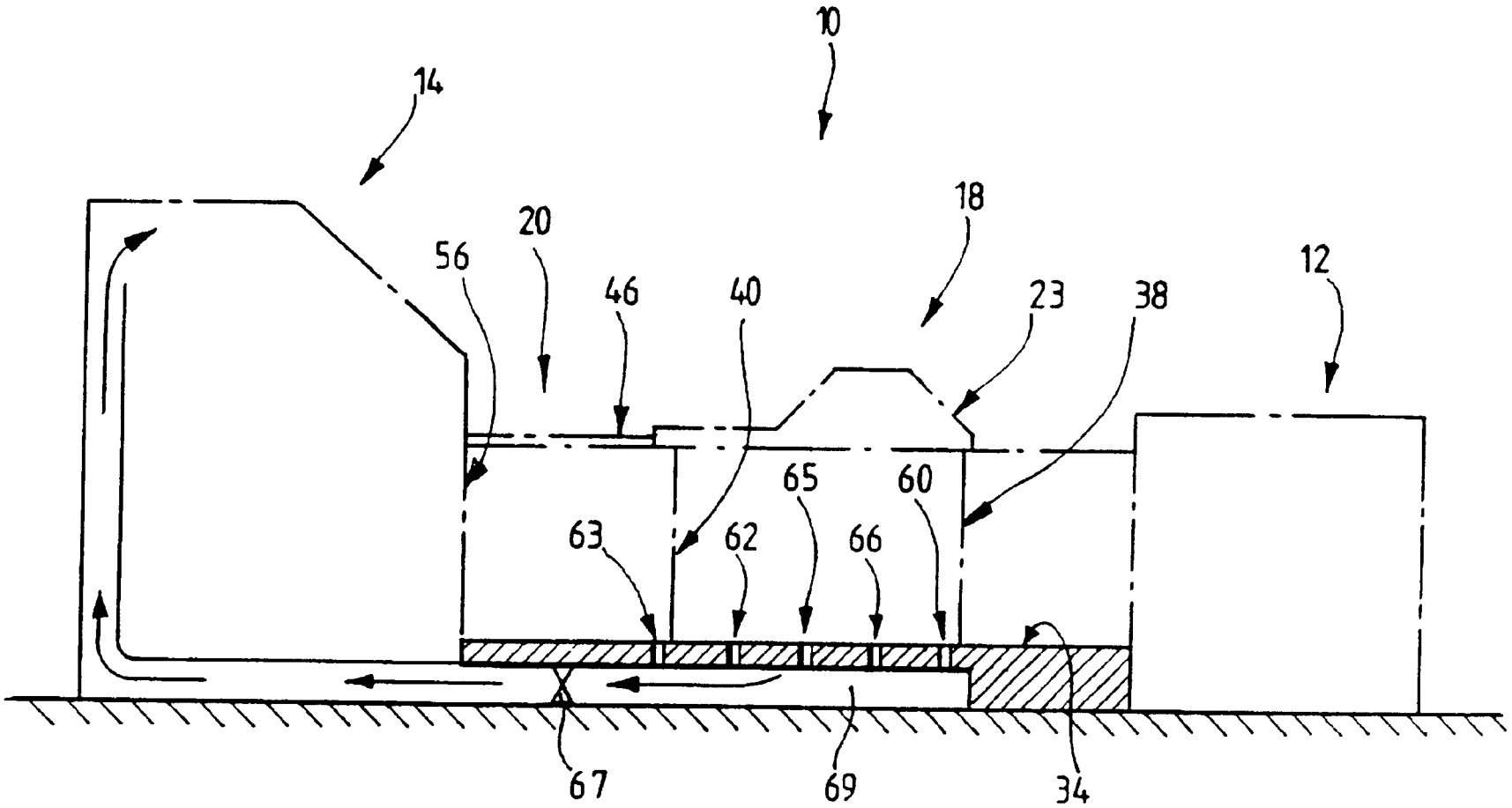
FIG. 6 is a diagrammatic drawing showing the machine's suction means in sectional side elevation.

Referring now to the drawings, a sheet coating machine, an adjoining sheet supplying mechanism therefor and an adjoining thermal drying oven therefor are indicated generally at 10, 12 and 14 respectively. The machine 10 has a flat bed 16 along which sheets are fed by conveyor means 17 and 19 through a working area comprising a coating station indicated generally at 18 where they are given a coating of a volatile substance such as lacquer and, downstream of the coating station 18, a sheet reject station indicated generally at 20 which allows a sheet to be withdrawn from the bed 16 for inspection. From the sheet reject station 20 the sheets normally pass to the oven 14 where the coating is cured. The coating station 18 has a humped cover 23 which is pivotally raiseable about an axis 21 through about 90 degrees to the position shown in broken lines at 22 in FIG. 1 by means of a hydraulic cylinder 24 (see FIG. 4) which is power-operated with push-button control and is aided by a counterweight 26, to provide unrestricted access when necessary to said station. The cover 23 rests on the bed 16 when in its lowered operational position illustrated in full lines in FIG. 1 so as to enable vapours produced by evaporation from the substance to be contained within the coating station 18, and is provided with glass inspection panels 28, areas of air inlet vents 30, and further air inlet vents (not shown) in a small access door 32. The coating station 18 has a base which is part of a continuous base 34 for the whole machine 10, walls 36 along its sides, and respective upstream and downstream baffle plates 38 and 40 across its ends in order to contain the vapours within said station. The upper ends of the baffle plates 38 and 40 terminate just below the bed 16 to form a shallow slot permitting feeding of the sheets therealong. The coating station 18 includes a housing 42 for a replaceable tank 44 from which the substance is supplied to said station. Doors 45 are provided in the wails 36 to allow access to the coating station 18 when the cover 23 is raised in order to facilitate work on the machine by an operator. The sheet reject station 20 has a flat cover 46 which is pivotally raiseable about an axis 47 to the position shown in broken lines at 48 in FIG. 1, to provide access when necessary to said station, by means which are similar to those for raising the cover 23 but which are not shown because they are disposed on the other side of the machine 10. The cover 46 rests on the bed 16 when in its lowered operational position illustrated in full lines in FIG. 1 so as to enable vapours produced by evaporation from the substance to be contained within the sheet rejection station 20, and is provided with a glass inspection panel 50. The sheet reject station 20 has a floor 52 disposed above the base 34, walls 54 along its sides which are continuations of the walls 36 of the coating station 18, an upstream baffle plate across one end constituted by the downstream baffle plate 40 of the station 18, and a downstream baffle plate 56 across the other end in order to contain the vapours within the station 20. The upper end of the baffle plate 56 terminates just below the bed 16 to form a shallow slot permitting feeding of the sheets therealong. Air inlet vents (not shown) are provided in a reject sheet withdrawal door 58 in one of the walls 54. As best seen in FIGS. 5 and 6, suction means which are arranged to extract the vapours downwardly from within the working area 18, 20 include a duct 60 connected to the front zone of the base of the coating station 18, a duct 62 connected to the rear zone of the base of said station, said zones being delineated by boundary walls 64, a duct 66 connected to the housing 42 for the tank 44, a duct 63 connected to the sheet reject station 20, and a duct 65 connected to a gearbox 71 for driving the machine 10. The suction means also include a suction fan 67 housed alongside the machine 10 which extracts all the vapours from the working area 18, 20 of the machine 10 downwardly through the aforesaid ducts into the base of the machine whence they pass through a common duct 69 into an upper zone of the oven 14 where they are incinerated. The suction fan is sufficiently powerful to maintain a slight negative gauge pressure within the working area 18, 20, which effectively draws in fresh air through the inlet vents hereinbefore referred to. However, as the concentration of vapours within the working area 18, 20 can be high because the operator is not exposed thereto, the requisite extraction flow rate is relatively low thus providing high oven thermal efficiency and low running costs. The machine 10 has front and rear platforms 68 and a hand-rail 70 for the use of the operator, and is provided with a hoist 72 with a jib 74 for enabling machine elements to be changed. Said hoist is disposed above the working area 18, 20 and is completely unimpeded by the suction means which are arranged to extract the vapours downwardly aided by the fact that said vapours are heavier than air. During setting and checking of the machine 10 when one or both of the covers 23 and 46 is or are raised and the extraction system is still in operation, vapours are not drawn upwardly past the head of the operator but are safely drawn downwardly into the base of the machine.

In a modification, the working area of the machine comprises simply a coating station, no sheet reject station being provided.

What is claimed is:

1. A sheet coating machine in which sheets are fed along a bed through a working area where they are given a coating of a volatile substance to an adjoining oven where the coating is cured, at least one cover which is moveable to provide access when necessary to the working area and which enables vapours produced by evaporation from the substance to be contained within the working area, air inlet means which enable the vapours to be extracted for incineration, and suction means which are arranged to extract the vapours downwardly from within the working area.

2. A sheet coating machine according to claim 1, wherein the working area comprises a coating station having a moveable cover which provides access when necessary to the coating station.

3. A sheet coating machine according to claim 2, wherein the air inlet means of the coating station comprise vents in the moveable cover.

4. A sheet coating machine according to claim 2 or claim 3, wherein the coating station is provided with a base, walls along its sides, and upstream and downstream baffle plates across its ends in order to contain the vapours within the coating station, the baffle plates being adapted to permit feeding of the sheets along the bed.

5. A sheet coating machine according to claim 2 or claim 3, wherein the working area comprises also a sheet reject station disposed between the coating station and the oven and having another moveable cover which provides access when necessary to the sheet reject station.

6. A sheet coating machine according to claim 5, wherein the sheet reject station is provided with a floor, walls along its sides, and upstream and downstream baffle plates across its ends in order to contain the vapours within the sheet reject station, the baffle plates being adapted to permit feeding of the sheets along the bed.

7. A sheet coating machine according to claim 6, wherein the walls of the sheet reject station are continuations of the walls of the coating station, and the upstream baffle plate of the sheet reject station and the downstream baffle plate of the coating station are one and the same element.

8. A sheet coating machine according to claim 6, wherein the air inlet means of the sheet reject station comprise vents in a reject sheet withdrawal door in one of the walls.

9. A sheet coating machine according to claim 1 or claim 2, wherein the suction means which are arranged to extract the vapours downwardly comprise ducts connected to the base of the coating station, to the sheet reject station, to a gearbox for driving the machine, and to a housing for a replaceable tank from which the substance is supplied to the coating station.

10. A sheet coating machine according to claim 9, wherein the ducts communicate with a common duct in the base of the machine leading to an upper zone of the oven.

11. A sheet coating machine according to claim 1 or claim 2, provided with a hoist for enabling machine elements to be changed which is disposed above the working area and is completely unimpeded by the suction means which are arranged to extract the vapours downwardly.

* * * * *